US007615915B2

(12) United States Patent
Ito et al.

(10) Patent No.: US 7,615,915 B2
(45) Date of Patent: Nov. 10, 2009

(54) SPARK PLUG

(75) Inventors: Hirohito Ito, Kounan (JP); Takahiro Matsuura, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 205 days.

(21) Appl. No.: 11/785,840

(22) Filed: Apr. 20, 2007

(65) Prior Publication Data

US 2007/0277764 A1 Dec. 6, 2007

Related U.S. Application Data

(62) Division of application No. 10/948,140, filed on Sep. 24, 2004, now Pat. No. 7,352,121.

(60) Provisional application No. 60/602,040, filed on Aug. 17, 2004.

(30) Foreign Application Priority Data

Sep. 26, 2003 (JP) ..... P.2003-336322

(51) Int. Cl.
*H01T 13/20* (2006.01)

(52) U.S. Cl. ..... 313/141; 123/169 R

(58) Field of Classification Search ..... 313/141, 313/143; 123/169 R, 169 EL; 445/7
See application file for complete search history.

(56) References Cited

U.S. PATENT DOCUMENTS 6,307,307 B1 * 10/2001 Kanao ..... 313/142
6,642,638 B2 * 11/2003 Ishiguro ..... 313/141
6,831,397 B2 12/2004 Kanao et al.
2001/0029916 A1 10/2001 Kanao
2002/0003389 A1 * 1/2002 Ishiguro ..... 313/141
2002/0038992 A1 4/2002 Morita et al.
2002/0067111 A1 6/2002 Shibata et al.
2002/0105254 A1 * 8/2002 Hori et al. ..... 313/141
2002/0158559 A1 10/2002 Sugiyama et al.
2003/0038577 A1 2/2003 Hori et al.

(Continued)

FOREIGN PATENT DOCUMENTS

EP 1276189 A1 1/2003

(Continued)

*Primary Examiner*—Toan Ton
*Assistant Examiner*—Hana A Sanei
(74) *Attorney, Agent, or Firm*—Sughrue Mion, PLLC

(57) ABSTRACT

A spark plug having a protrusion amount t of not smaller than 0.3 mm and satisfying a relation $\theta 1+\theta 2 \leqq 93°$ in which $\theta 1$ is an included angle between virtual lines s1 and s2, and $\theta 2$ is an included angle between virtual lines s3 and s4 when the virtual line s1 is taken as a line parallel to a direction of an axis and including the other end side edge on a leading end surface of a first precious metal tip, the virtual line s2 is taken as a line connecting the other end side edge and a point of intersection between an inner circumferential surface of a ground electrode body and the other end surface of the ground electrode body, the virtual line s3 is taken as a line parallel to the direction of the axis and including the other end side edge on a leading end surface of a center electrode, and the virtual line s4 is taken as a line including the other end side edge and tangent to an insulator.

7 Claims, 4 Drawing Sheets

U.S. PATENT DOCUMENTS

| | | | | |
|---|---|---|---|---|
| 2003/0155849 | A1 | 8/2003 | Hori | |
| 2003/0193282 | A1 | 10/2003 | Shibata et al. | |
| 2004/0061421 | A1* | 4/2004 | Morita et al. | 313/142 |
| 2005/0023949 | A1* | 2/2005 | Hori | 313/141 |

FOREIGN PATENT DOCUMENTS

| | | | |
|---|---|---|---|
| JP | 56-153677 | A | 11/1981 |
| JP | 2001-345162 | A | 12/2001 |
| JP | 2002-237365 | A | 8/2002 |
| JP | 2002-313524 | A | 10/2002 |

* cited by examiner

SPARK PLUG

CROSS REFERENCE TO RELATED APPLICATIONS

This application is a divisional application of U.S. application Ser. No. 10/948,140 filed Sep. 24, 2004, now U.S. Pat. No. 7,352,121 which claims benefit of U.S. Provisional Application No. 60/602,040 filed Aug. 17, 2004, the above-noted applications incorporated herein by reference in their entirety.

BACKGROUND OF THE INVENTION

1. Field of the Invention

The present invention relates to a spark plug used for ignition of an internal combustion engine.

2. Description of the Related Art

As for spark plugs used for ignition of an internal combustion engine such as an automobile engine, many spark plugs of the type having a first precious metal tip bonded to the vicinity of a leading end of a ground electrode body (i.e., the end opposite the end of the ground electrode body that is bonded to a metal shell) have been proposed for the following reason. This type of spark plug is provided so that an igniter portion of the spark plug protrudes into a combustion chamber to improve ignitability of the spark plug. Accordingly, the igniter portion is exposed to a high temperature.

While the demand for higher engine performance has recently increased, greater improvement in ignitability has been required of the spark plug. Increasing the axial-direction distance (hereinafter also referred to as protrusion amount) between a leading end surface of a first precious metal tip (bonded to the ground electrode body) opposite a center electrode and an inner circumferential surface of the ground electrode is effective for improving ignitability. This is for the following reason. A flame core generated in a spark discharge gap formed between the center electrode and the ground electrode (or the first precious metal tip) will tend to grow due to swirling or the like. However, there is a possibility that the flame core will contact the ground electrode body so as to impede its growth (hereinafter also referred to as extinction action) if the protrusion amount is small. Therefore, a structure in which the protrusion amount of the first precious metal tip bonded to the ground electrode body is made large to thereby accelerate growth of the flame core has been widely used (see Japanese Patent Laid-Open No. 2001-345162).

However, even in a spark plug having an increased protrusion amount as described in Japanese Patent Laid-Open No. 2001-345162, the extinction action may still occur to impede growth of the flame core. This is because the spark plug has a structure in which the flame core contacts the ground electrode body or the insulator while it is growing. For this reason, ignitability cannot be satisfactorily ensured.

SUMMARY OF THE INVENTION

It is therefore an object of the present invention to provide a spark plug having an increased protrusion amount and excellent ignitability, and which prevents, to the extent possible, a ground electrode body or insulator from contacting a flame core, so that growth of the flame core is not disturbed by the ground electrode body or the insulator.

The above object of the present invention has been achieved by providing a spark plug having: an insulator having an axial hole formed in an axial direction along an axis of said spark plug; a center electrode disposed in the axial hole of the insulator and on a leading end side of the axial hole; a metal shell surrounding the insulator; and a ground electrode including a ground electrode body having one end joined to the metal shell, and a first precious metal tip formed in the other end portion of the ground electrode body so that a leading end surface of the first precious metal tip is disposed opposite the center electrode, wherein: an axial-direction distance t between the leading end surface of the first precious metal tip and an inner circumferential surface of the ground electrode body is not smaller than 0.3 mm; and the spark plug satisfies the relation $\theta 1+\theta 2 \leqq 93°$ in which $\theta 1$ is an included angle between virtual lines s1 and s2, and $\theta 2$ is an included angle between virtual lines s3 and s4, wherein virtual line s1 is taken as a line parallel to the axial direction and including the other end side edge on the leading end surface of the first precious metal tip in a section passing through the center of the other end surface of the ground electrode body and including the axis, virtual line s2 is taken as a line connecting the other end side edge on the leading end surface of the first precious metal tip and a point of intersection between the inner circumferential surface of the ground electrode body and the other end surface of the ground electrode body, virtual line s3 is taken as a line parallel to the axial direction and including the other end side edge on the leading end surface of the center electrode in the section, and virtual line s4 is taken as a line including the other end side edge on the leading end surface of the center electrode and tangent to the insulator.

The spark plug according to the invention is configured so that the axial-direction distance t between the leading end surface of the first precious metal tip and the inner circumferential surface of the ground electrode body is not smaller than 0.3 mm. When the protrusion amount of the first precious metal tip from the ground electrode body is increased in this manner, there is a lowered possibility that a flame core generated in a spark discharge gap formed between the center electrode and the first precious metal tip will contact the ground electrode body while the flame core grows due to swirling or the like. Accordingly, growth of the flame core is accelerated, so that ignitability is improved. If the axial-direction distance t between the leading end surface of the first precious metal tip and the inner circumferential surface of the ground electrode body is smaller than 0.3 mm, it is difficult to effectively prevent the flame core from contacting the ground electrode body, as described above. Preferably, the axial-direction distance t between the leading end surface of the first precious metal tip and the inner circumferential surface of the ground electrode body is set to be not larger than 1.5 mm. If the axial-direction distance t between the leading end surface of the first precious metal tip and the inner circumferential surface of the ground electrode body is larger than 1.5 mm, the heat capacity of the first precious metal tip is increased to thereby lower the durability of the first precious metal tip.

As used herein, the "inner circumferential surface of the ground electrode body" means a surface of the ground electrode on a side opposite the center electrode.

Further, the spark plug according to the invention is configured such that the spark plug satisfies the relation $\theta 1+\theta 2 \leqq 93°$ in which $\theta 1$ is an included angle between virtual lines s1 and s2, and $\theta 2$ is an included angle between virtual lines s3 and s4, wherein virtual line s1 is taken as a line parallel to the axial direction and including the other end side edge on the leading end surface (opposite the center electrode) of the first precious metal tip in a section passing through the center of the other end surface of the ground electrode body and including the axis, virtual line s2 is taken as a line connecting the other end side edge on the leading end surface of the first precious metal tip and a point of intersection between the inner circumferential surface of the ground electrode body and the other end surface of the ground electrode body, virtual line s3 is taken as a line parallel to the axial direction and including the other end side edge on the leading end surface (opposite the ground electrode) of the center electrode in the section, and virtual line s4 is taken as a line including the other end side edge on the leading end surface of the center electrode and tangent to the insulator.

Even in a spark plug having an increased protruding amount as described above, the extinction action may still occur to impede growth of the flame core. This is because the spark plug has a structure in which the flame core contacts the ground electrode body or the insulator when the flame core grows. When the spark plug is configured according to the invention such that the spark plug satisfies the relation $\theta 1+\theta 2 \leqq 93°$ in which θ1 is an included angle between virtual lines s1 and s2, and θ2 is an included angle between virtual lines s3 and s4, wherein virtual line s1 is taken as a line parallel to the axial direction and including the other end side edge on the leading end surface of the first precious metal tip in a section including the axis, virtual line s2 is taken as a line connecting the other end side edge on the leading end surface of the first precious metal tip and a point of intersection between the inner circumferential surface of the ground electrode body and the other end surface of the ground electrode body, virtual line s3 is taken as a line parallel to the axial direction and including the other end side edge on the leading end surface of the center electrode in the section, and virtual line s4 is taken as a line including the other end side edge on the leading end surface of the center electrode and tangent to the insulator, it is possible to reduce the contact surface of the ground electrode body (located on the other end portion side with respect to the other end side edge on the leading end surface of the first precious metal tip) or the contact surface of the insulator (located on the other end portion side with respect to the other end side edge on the leading end surface of the center electrode). Moreover, it is possible to reduce the possibility that the flame core will contact the ground electrode body or the insulator as the flame core grows. Consequently, the flame core can grow efficiently and ignitability can be further improved. If the value of θ1+θ2 is larger than 93°, it is difficult to efficiently grow the flame core in the aforementioned manner. It is a matter of course that each of θ1 and θ2 is not smaller than 0°. In addition, the value of θ1+θ2 is preferably not larger than 85°, more preferably not larger than 50°. As used herein, the "included angle" means an angle held between the virtual lines s1 and s2 (or between s3 and s4). In the invention, the included angle is an acute angle. Further, θ2 is preferably not smaller than 35°. When θ2 is set to be not smaller than 35°, the thickness of the insulator can be sufficiently ensured so as to prevent the insulator from being pierced.

Preferably, in the spark plug according to the invention, the included angle θ1 between the virtual lines s1 and s2 is not larger than 45°. For greater improvement in ignitability, it is necessary to more effectively accelerate the growth of the flame core in a combustion chamber of an engine. The ground electrode is generally attached to an inner side of the combustion chamber relative to the center electrode. For this reason, when the flame core is prevented to a greater extent from contacting the ground electrode body, ignitability can be further improved. Accordingly, when θ1 is set to be not larger than 45°, the possibility that the flame core will contact the ground electrode body when the flame core grows can be sufficiently lowered, so that the flame core is grown more efficiently. Consequently, ignitability is further improved. If θ1 is larger than 45°, it is difficult to efficiently grow the flame core in the aforementioned manner.

Preferably, in the spark plug according to the invention, the center electrode includes a second precious metal tip in the shape of a column and formed at a leading end of the center electrode; and the first precious metal tip is in the shape of a column so that the diameter of the first precious metal tip on the leading end surface of the first precious metal tip is larger than the diameter of the second precious metal tip on the leading end surface of the second precious metal tip and not larger than 0.8 mm. Generally, a spark plug may have a second precious metal tip in the shape of a column and disposed at a leading end of a center electrode. This is because an igniter portion on the center electrode side, as well as on the ground electrode side, is exposed to a high temperature. When the diameter of each of the first and second precious metal tips is set to be not larger than 0.8 mm, the ignitability of the spark plug can be improved effectively. If the diameter of either the first precious metal tip or the second precious metal tip is set to be larger than 0.8 mm, there is a possibility that ignitability will be lowered.

When the spark plug provided with the first and second precious metal tips is attached to an internal combustion engine, the first precious metal tip wears out more easily than the second precious metal tip. This is considered to occur for the following reason. That is, since the ground electrode is attached to the inner side of the combustion chamber relative to the center electrode as described above, the first precious metal tip more deeply protrudes into the combustion chamber. Accordingly, heat received form the inside of the combustion chamber can hardly be radiated from the first precious metal tip toward an engine head or the like. Therefore, in this invention, the diameter of the first precious metal tip is set to be larger than the diameter of the second precious metal tip. According to this configuration, the wear resistance of the first precious metal tip can also be enhanced.

Preferably, in the spark plug according to the invention, the center electrode includes a tapered portion having a reduced diameter toward a tip of the tapered portion; and the point of intersection between the inner circumferential surface of the ground electrode body and the other end surface of the ground electrode body is located opposite the tapered portion when a section is taken. According to this configuration, a contact surface of the ground electrode body located on the other end portion side with respect to the other end side edge on the leading end surface of the first precious metal tip can be sufficiently reduced, such that the flame core can be grown efficiently. Accordingly, the ignitability of the spark plug can be further improved.

For bonding the first precious metal tip and the ground electrode body to each other, laser welding can be utilized as an effective bonding method. Preferably, in the spark plug according to the invention, the ground electrode further includes a molten portion between the first precious metal tip and the ground electrode body; and the molten portion is formed such that the first precious metal tip is laser-welded to the ground electrode body so that the shortest distance D1 between the first precious metal tip and the other end surface of the ground electrode body is not smaller than 0.25 mm. According to this configuration, laser welding can be performed such that a space for forming the molten portion by laser welding is sufficiently secured between the first precious metal tip and the other end surface of the ground electrode body. In this manner, the first precious metal tip and the ground electrode body can be firmly bonded to each other. If the shortest distance D1 between the first precious metal tip and the other end surface of the ground electrode body is smaller than 0.25 mm, there is a possibility that the first precious metal tip cannot be firmly bonded to the ground electrode body by the molten portion formed by laser welding.

Preferably, in the spark plug according to the invention, the molten portion is formed to extend to the other end surface of the ground electrode body. When the limited space between the first precious metal tip and the other end surface of the ground electrode body is used most effectively for forming the molten portion, the bonding strength between the first precious metal tip and the ground electrode body can be maximized. On the other hand, the contact surface of the ground electrode body located on the other end portion side with respect to the other end side edge on the leading end surface of the first precious metal tip can be efficiently reduced, to the extent possible, so that the flame core can be grown more efficiently.

As described above, in order to lower the possibility of the flame core coming into contact with the ground electrode body to the extent possible, the shortest distance D1 between the first precious metal tip and the other end surface of the ground electrode body is preferably, reduced to a sufficient extent as possible. As a result, the space for forming the molten portion is limited. That is, the length of the molten portion cannot be larger than the shortest distance D1 between the first precious metal tip and the other end surface of the ground electrode body. Consequently, there is a concern that sufficient bonding strength cannot be obtained on the other end side of the ground electrode body with respect to the first precious metal tip. Therefore, preferably, in the spark plug according to the invention, the shortest distance D1 satisfies the relation D2>D1 in which D2 is the shortest distance between the first precious metal tip and a portion of the molten portion nearest to one end of the ground electrode body viewed from the inner circumferential surface of the ground electrode body. That is, the length of the molten portion on one end side (i.e. the metal shell side) of the ground electrode with respect to the first precious metal tip does not suffer such limitation as that on the other end side of the ground electrode with respect to the first precious metal tip. Consequently, the molten portion can be formed on one end side of the ground electrode so as to have a width larger than the shortest distance D1 between the first precious metal tip and the other end surface of the ground electrode body. As a result, the bonding strength between the first precious metal tip and the ground electrode body can be improved as a whole in the limited space for forming the molten portion.

Preferably, in the spark plug according to the invention, the ground electrode body has a slope formed in a corner portion between each of opposite side surfaces of the ground electrode body and the other end surface of the ground electrode body; and the ground electrode body satisfies the relation D3<D1 in which D3 is the shortest distance between the first precious metal tip and the slope, and D1 is the shortest distance between the other end surface of the ground electrode body and the first precious metal tip viewed from the inner circumferential surface of the ground electrode body. When the slope is provided in the ground electrode body so as to satisfy the relation D3<D1, the contact surface of the ground electrode body near the first precious metal tip can be further reduced. Consequently, the possibility of the flame core coming into contact with the ground electrode body can be reduced.

For bonding the first precious metal tip and the ground electrode body to each other, laser welding can be utilized as an effective bonding method. Preferably, in the spark plug according to the invention, the ground electrode further includes a molten portion between the first precious metal tip and the ground electrode body; and the molten portion is formed such that the first precious metal tip is laser-welded to the ground electrode body under the condition that the shortest distance D3 between the first precious metal tip and the slope is not smaller than 0.25 mm. According to this configuration, laser welding can be performed such that space for forming the molten portion by laser welding can be sufficiently secured between the first precious metal tip and the slope of the ground electrode. In this manner, the first precious metal tip and the ground electrode body can be firmly bonded to each other.

Preferably, in the spark plug according to the invention, the molten portion is formed to extend to the slope. When the limited space between the first precious metal tip and the slope is used most effectively for forming the molten portion, the bonding strength between the first precious metal tip and the ground electrode body can be maximized. On the other hand, the contact surface of the ground electrode body located on the other end portion side with respect to the other end side edge on the leading end surface of the first precious metal tip can be sufficiently reduced, so that the flame core can be grown efficiently.

As described above, in order to reduce the possibility of the flame contacting the ground electrode body to the extent possible, the shortest distance D3 between the first precious metal tip and the slope of the ground electrode body is preferably reduced to a sufficient extent as possible. As a result, the space for forming the molten portion is limited. That is, the length of the molten portion between the first precious metal tip and the slope cannot be larger than the shortest distance D3. As a result, there is a concern that sufficient bonding strength cannot be obtained between the slope of the ground electrode body and the first precious metal tip. Therefore, preferably, in the spark plug according to the invention, the shortest distance D3 satisfies the relation D2>D3 in which D2 is the shortest distance between the first precious metal tip and a portion of the molten portion nearest to one end of the ground electrode body as viewed from the inner circumferential surface of the ground electrode body. That is, the length of the molten portion on one end side (i.e. the metal shell side) of the ground electrode with respect to the first precious metal tip does not suffer such limitation as that between the first precious metal tip and the slope of the ground electrode body. Consequently, the molten portion can be formed on one end side of the ground electrode so as to have a width larger than the shortest distance D3 between the first precious metal tip and the slope of the ground electrode body. As a result, the bonding strength between the first precious metal tip and the ground electrode body can be improved as a whole in the limited space for forming the molten portion.

DESCRIPTION OF REFERENCE NUMERALS

Figure 1:
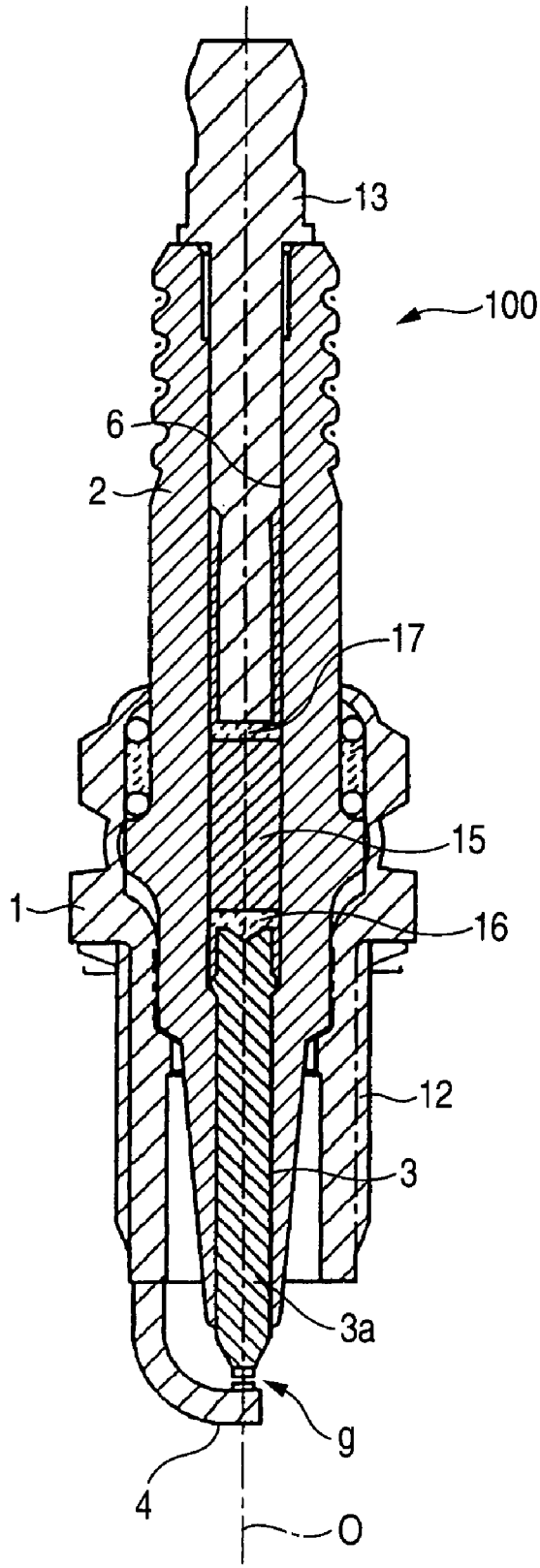
FIG. 1 is a front sectional view showing a spark plug according to Embodiment 1 of the invention.

1: metal shell
2: insulator
3: center electrode
4: ground electrode
6: through-hole
31: second precious metal tip
41, 241: first precious metal tip

41*a*, 241*a*: leading end surface of the first precious metal tip 41, 241

100, 200: spark plug

O: spark plug lengthwise axis

DETAILED DESCRIPTION OF THE INVENTION

The invention will now be described below with reference to the drawings. However, the present invention should not be construed as being limited thereto.

Figure 2:
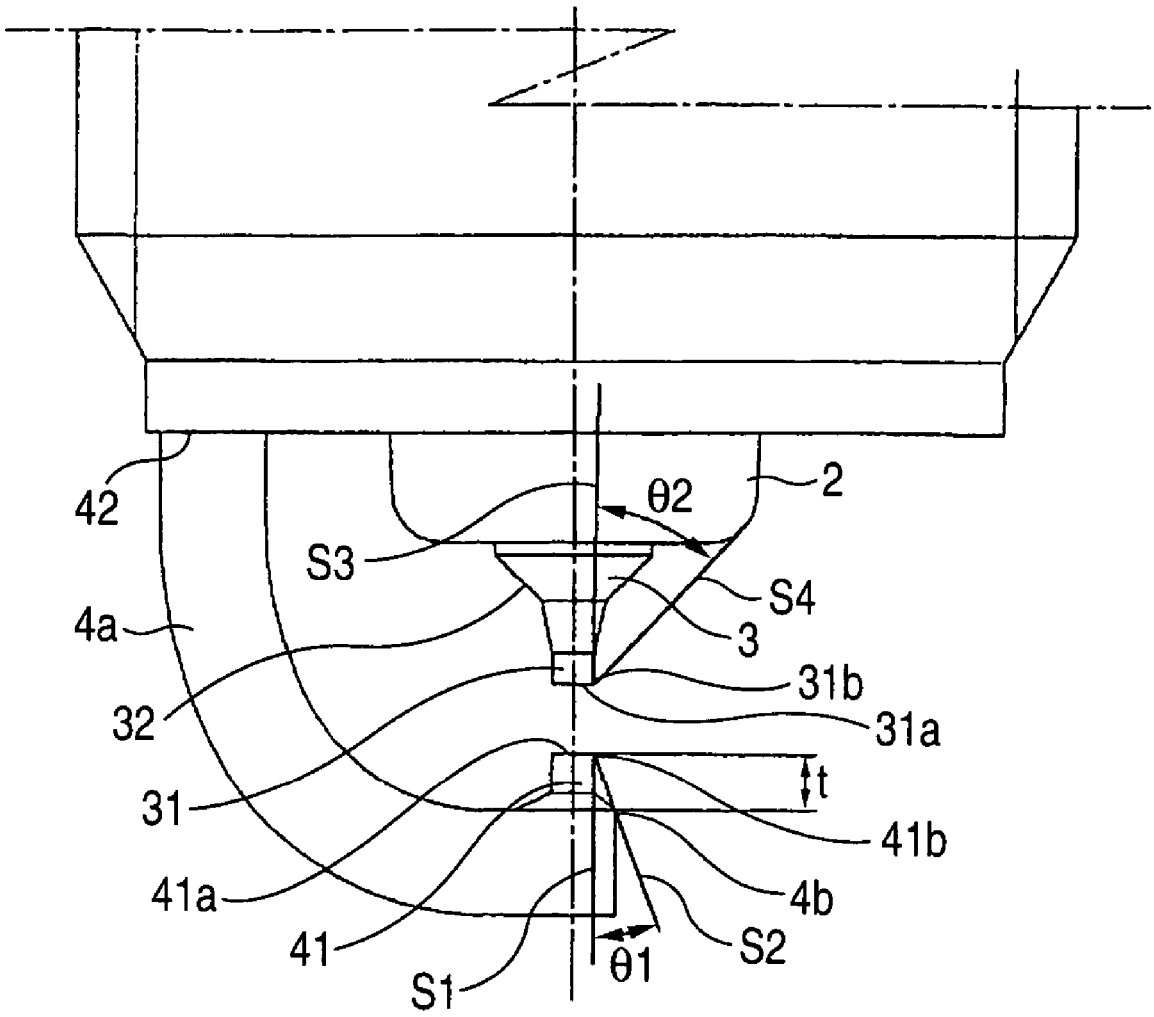
FIG. 2 is a front sectional view showing a main part of FIG. 1.
Figure 3:
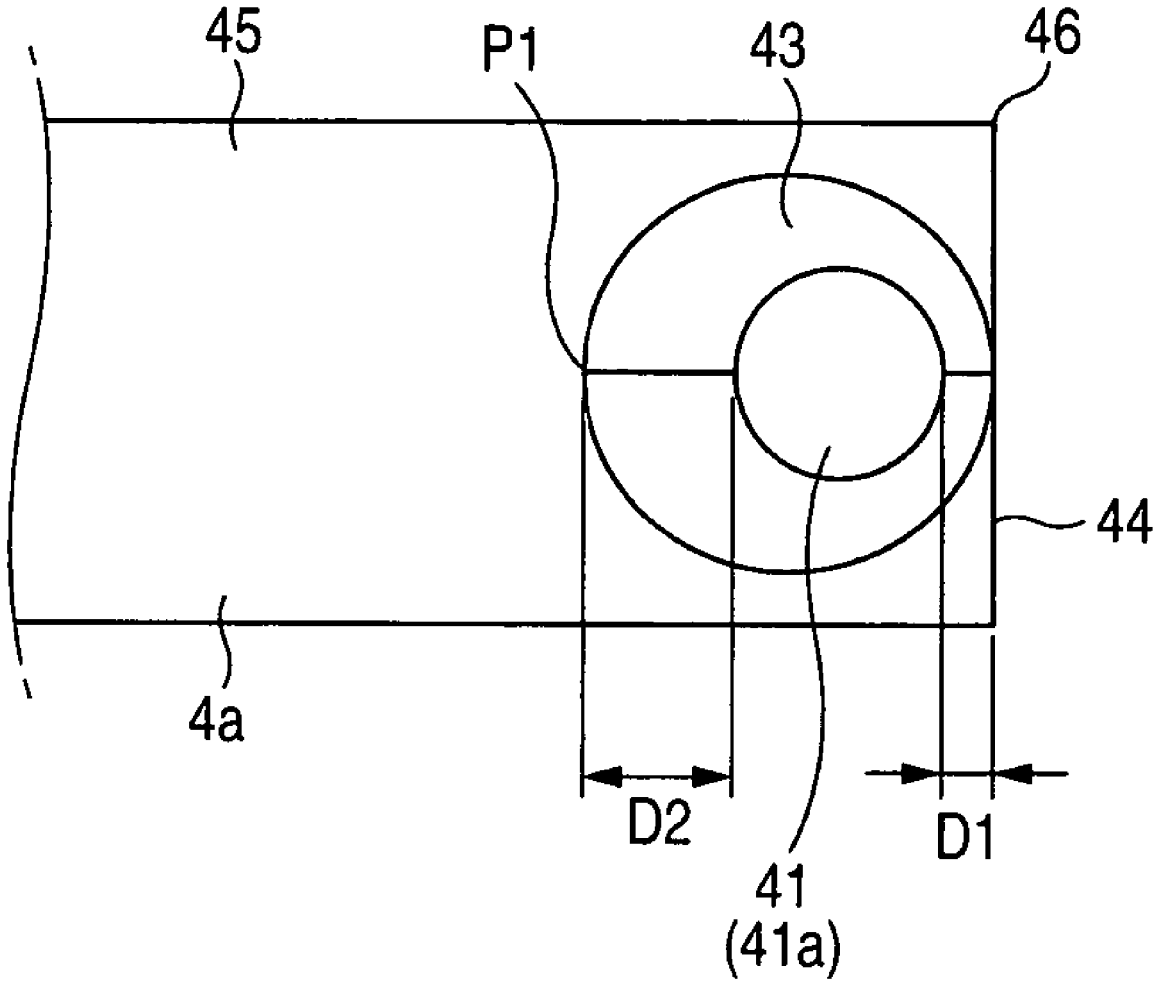
FIG. 3 is a front view of an inner circumferential surface 45 of a ground electrode body 4*a* depicted in FIG. 1.

FIGS. 1 to 3 show a resistor-including spark plug 100 according to Embodiment 1 of the invention. The resistor-including spark plug 100 has a cylindrical metal shell 1, an insulator 2, a center electrode 3, and a ground electrode 4. The insulator 2 is fitted into the metal shell 1 so that a leading end portion of the insulator 2 protrudes from the metal shell 1. The center electrode 3 is provided inside the insulator 2 while the center electrode 3 has a second precious metal tip 31 protruding from the insulator 2. The ground electrode 4 has one end (a joint surface 42 of a ground electrode body) joined to the metal shell 1. The ground electrode 4 has a first precious metal tip 41 bonded to an inner circumferential surface 45 near the other end (an end surface 44 opposite the joint surface of the ground electrode body). The ground electrode 4 is bent so that a leading end surface of the first precious metal tip 41 is disposed opposite a leading end surface of the second precious metal tip 31. A spark gap g is formed between the first precious metal tip 41 and the second precious metal tip 31.

The metal shell 1 is made of carbon steel or the like. As shown in FIG. 1, a threaded portion 12 is formed in an outer circumferential surface of the metal shell 1 so that the spark plug 100 can be attached to an engine block not shown. The insulator 2 is made of a ceramic sintered body such as alumina or aluminum nitride. The insulator 2 has a through-hole 6 formed therein in its axial direction for fitting the center electrode 3. A terminal attachment 13 is fixedly inserted into one end portion of the through-hole 6. Likewise, the center electrode 3 is fixedly inserted into the other end portion of the through-hole 6. A resistor 15 is disposed in the through-hole 6 and between the terminal attachment 13 and the center terminal 3. Opposite end portions of the resistor 15 are electrically connected to the center electrode 3 and the terminal attachment 13 through sealing layers 16 and 17 of electrically conductive glass, respectively.

The center electrode 3 is made of an Ni alloy such as INCONEL 600 (registered trademark of Inco Limited). The leading end surface of the center electrode 3 is flattened while the diameter of the center electrode 3 on the leading end side is reduced. The second precious metal tip 31 is formed on the leading end surface of the center electrode 3 as follows. A disk-like or column-like precious metal tip is superposed on the leading end surface of the center electrode 3 and bonded by means of laser welding, electron beam welding, resistance welding or the like along an outer edge portion of the joint surface of the center electrode 3. Thus, the second precious metal tip 31 is formed. The second precious metal tip 31 is made of metal containing Pt, Ir and W as main components. Specifically, examples of the metal include: Pt alloys such as Pt—Ir and Pt—Rh; and Ir alloys such as Ir-5 wt % Pt, Ir-20 wt % Rh, Ir-5 wt % Pt-1 wt % Rh-1 wt % Ni and Ir-10 wt % Rh-5 wt % Ni. The second precious metal tip 31 is not limited thereto. Other known precious metal tips may be appropriately used.

One end (joint surface 42) of the ground electrode 4 is fixed to the leading end surface of the metal shell 1 by means of welding or the like so that the ground electrode 4 is integrated with the metal shell 1. On the other hand, the first precious metal tip 41 is bonded to the vicinity (the other end portion) of the other end (the end surface 44 opposite the joint surface 42) of the ground electrode body 4*a* so as to be disposed opposite the leading end surface of the center electrode (specifically, the precious metal tip 31). The first precious metal tip 41 is formed as follows. A disc-like or columnar precious metal tip is provided in a predetermined position of the ground electrode 4 and bonded by means of laser welding. Thus, the first precious metal tip 41 is formed. Electron beam welding, resistance welding or the like may be used as a fixing means other than the laser welding. The ground electrode body 4*a* is made of INCONEL 600. The first precious metal tip 41 is made of metal containing Pt, Ir and W as main components. Specifically, examples of the metal include: Pt alloys such as Pt-20 wt % Ni, Pt-20 wt % Rh and Pt-20 wt % Rh-5 wt % Ni; and Ir alloys such as Ir-5 wt % Pt, Ir-20 wt % Rh and Ir-11 wt % Ru-8 wt % Rh-1 wt % Ni. The first precious metal tip 41 is not limited thereto. Other known precious metal tip may be appropriately used.

The first precious metal tip 41 has a diameter of $\phi$0.6 mm and a protrusion amount t of 0.8 mm from the ground electrode body 4*a*. Since the protrusion amount t of the first precious metal tip 41 from the ground electrode body 4*a* is set to be not smaller than 0.3 mm, there is a low possibility that a flame core generated in the spark discharge gap g formed between the second precious metal tip 31 and the first precious metal tip 41 will come into contact with the ground electrode body 4*a* while growing due to swirling or the like. Accordingly, the growth of the flame nucleus is accelerated to thereby improve ignitability.

The second precious metal tip 31 has a diameter of $\phi$0.55 mm. When the diameter of each of the first and second precious metal tips 41 and 31 is set to be not larger than 0.8 mm, the ignitability of the spark plug can be effectively improved. Moreover, since the diameter of the first precious metal tip 41 is set to be larger than the diameter of the second precious metal tip 31, the wear resistance of the first precious metal tip 41 can be enhanced.

Moreover, when a virtual line s1 is taken as a line parallel to the axial direction and including the other end side edge 41*b* on the leading end surface 41*a* of the first precious metal tip 41 whereas a virtual line S2 is taken as a line connecting the other end side edge 41*b* and a point of intersection between the inner circumferential surface 45 of the ground electrode body 4*a* and the other end surface 44 of the ground electrode body 4*a*, an included angle of 20° is formed between the virtual lines s1 and s2. Moreover, when a virtual line s3 is taken as a line parallel to the axial direction and including the other end side edge 31*b* on the leading end surface 31*a* of the second precious metal tip 31 whereas a virtual line s4 is taken as a line including the other end side edge 31*b* and tangent to the insulator 2, an included angle of 45° is formed between the virtual lines s3 and s4. Let $\theta$1 be the included angle between the virtual lines s1 and s2. Let $\theta$2 be the included angle between the virtual lines s3 and s4. When the included angles $\theta$1 and $\theta$2 satisfy the relation $\theta 1+\theta 2 \leqq 93°$ in the aforementioned manner, it is possible to reduce the contact surface of the ground electrode body 4*a* (located on the other end portion side with respect to the other end side edge 41*b* on the leading end surface 41*a* of the first precious metal tip 41) and the contact surface of the insulator 2 (located on the other end portion side with respect to the other end side edge 31*b* in the leading end surface 31*a* of the second precious metal tip 31). Accordingly, the possibility of the flame core contacting the ground electrode body 4*a* or the insulator 2 while growing can be satisfactorily lowered and the flame core can be grown efficiently. Thus, ignitability is further improved.

Further, when the included angle θ1 between the virtual lines s1 and s2 is set to be not larger than 45°, the flame core can be prevented to a greater extent from contacting the ground electrode body 4*a* of the ground electrode 4 generally attached to the inner side of the combustion chamber relative to the center electrode 3. Consequently, the flame core can be grown more efficiently, so that ignitability can be further improved.

As shown in FIG. 2, the point 4*b* of intersection between the inner circumferential surface 45 of the ground electrode body 4*a* and the other end surface 44 of the ground electrode body 4*a* is disposed opposite a tapered portion 32 of the center electrode 3. For this reason, the contact surface of the ground electrode body 4*a* (located on the other end portion side with respect to the other side edge 41*b* on the leading end surface 41*a* of the first precious metal tip 41) can be further reduced, so that the flame core can be grown efficiently. Accordingly, the ignitability of the spark plug is further improved.

As shown in FIG. 3, the shortest distance D1 between the first precious metal tip 41 and the other end surface 44 of the ground electrode body 4*a* is about 0.29 mm. When the shortest distance D1 between the first precious metal tip 41 and the other end surface 44 of the ground electrode body 4*a* is set to be not smaller than 0.25 mm in the aforementioned manner, a space for forming a molten portion 43 by laser welding can be secured sufficiently between the first precious metal tip 41 and the other end surface 44 of the ground electrode body 4*a*, so that the first precious metal tip 41 and the ground electrode body 4*a* can be firmly bonded to each other.

The molten portion 43 is formed to extend to the other end surface 44 of the ground electrode body 4*a*. Accordingly, when the limited space between the first precious metal tip 41 and the other end surface 44 of the ground electrode body 4*a* is used most effectively to form the molten portion 43, the bonding strength between the first precious metal tip 41 and the ground electrode body 4*a* can be maximized.

The shortest distance D2 between the first precious metal tip 41 and a portion P1 of the molten portion 43 nearest to one end 42 of the ground electrode body 4*a* is about 1.0 mm. When the shortest distance D2 is set to be larger than the shortest distance D1 between the first precious metal tip 41 and the other end surface 44 of the ground electrode body 4*a*, that is, D2>D1, in this manner, the bonding strength between the first precious metal tip 41 and the ground electrode body 4*a* can be improved as a whole in the limited space for forming the molten portion 43. In order to sufficiently obtain such an effect, in this embodiment, D2 is set to be not smaller than twice as large as D1.

Figure 4:
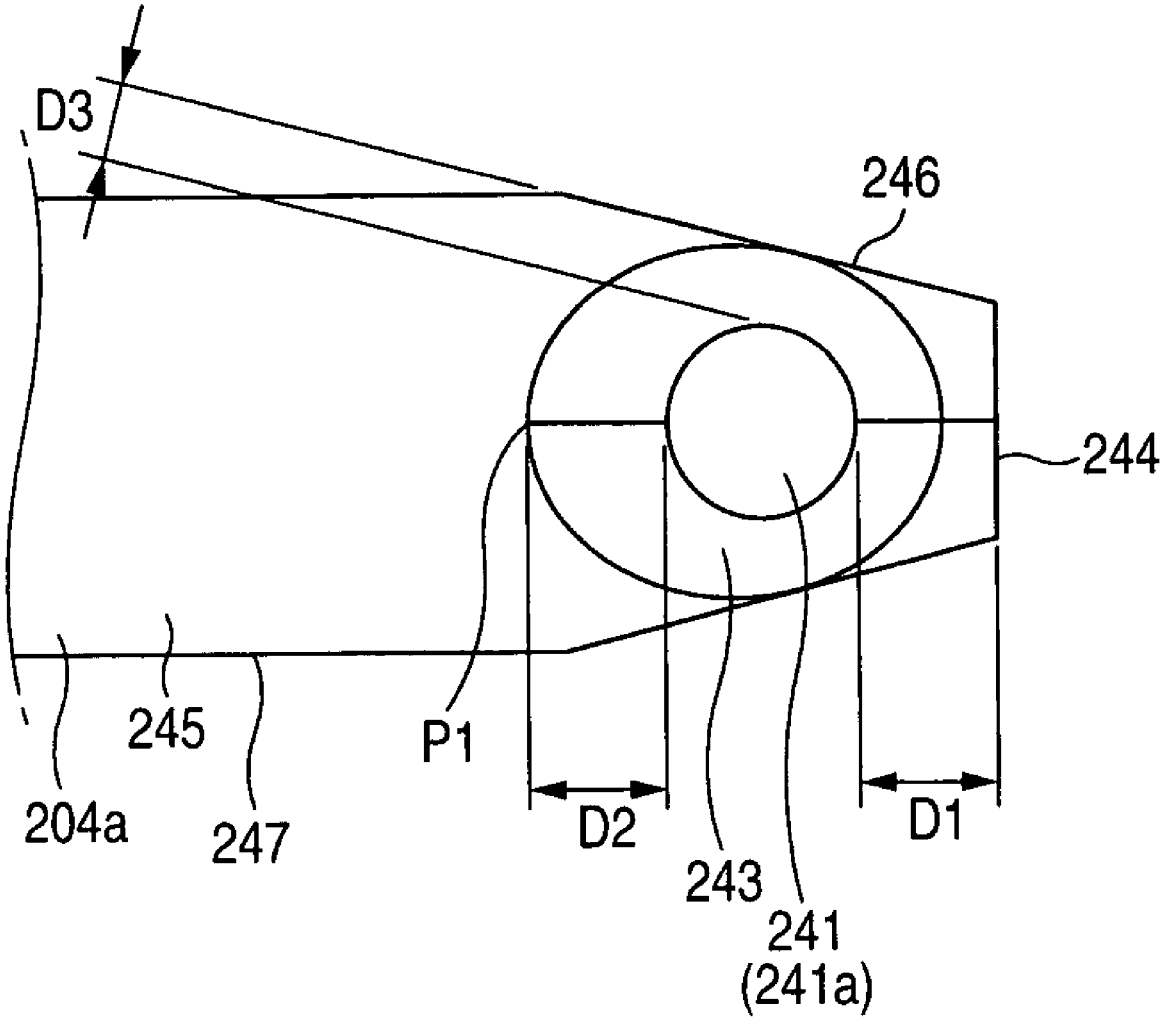
FIG. 4 is a front view of an inner circumferential surface 245 of a ground electrode body 204*a* of the spark plug according to Embodiment 2 of the invention.

Next, Embodiment 2 of the invention will be described with reference to FIG. 4. The spark plug according to Embodiment 2 is different from the spark plug 100 according to Embodiment 1 mainly in the shape of the ground electrode body 4*a*. Accordingly, a description of structural elements different from those of the spark plug 100 according to Embodiment 1 will mainly be made, while description of the same structural elements as those of the spark plug 100 will be omitted or simplified.

Similar to the spark plug 100, the spark plug according to Embodiment 2 has a cylindrical metal shell 1, an insulator 2, a center electrode 3, and a ground electrode 204. The insulator 2 is fitted into the metal shell 1 so that a leading end portion of the insulator 2 protrudes from the metal shell 1. The center electrode 3 is provided inside the insulator 2 while a second precious metal tip 31 is protruded from the insulator 2. The ground electrode is disposed opposite a leading end surface of the second precious metal tip 31 (the center electrode 3). The ground electrode has a ground electrode body 204*a* made of INCONEL 600. As shown in FIG. 4, a first precious metal tip 241 is provided on the other end portion of the ground electrode. The first precious metal tip 241 is formed as follows. A disc-like or columnar precious metal tip is provided in a predetermined position of the ground electrode body 204*a* and fixed by means of laser welding. Thus, the first precious metal tip 241 is formed. Incidentally, electron beam welding, resistance welding or the like may be used as a fixing means other than laser welding. The first precious metal tip 241 is made of metal containing Pt, Ir and W as main components. Specifically, examples of the metal include: Pt alloys such as Pt-20 wt % Ni and Pt-20 wt % Rh; and Ir alloys such as Ir-5 wt % Pt and Ir-20 wt % Rh.

The ground electrode body 204*a* has a pair of slopes (chamfers) 246 formed respectively in a corner portion (equivalent to a corner portion 46 in Embodiment 1) between each of opposite side surfaces 247 of the ground electrode body 204*a* and the other end surface 244 of the ground electrode body 204*a*. The shortest distance D3 between the slope 246 and the first precious metal tip 241 is about 0.27 mm. On the other hand, the shortest distance D1 between the other end surface 244 of the ground electrode body 204*a* and the precious metal tip 241 is about 0.29 mm. When the slope 246 satisfying the relation D3<D1 is provided in the ground electrode body 204*a*, a contact surface of the ground electrode body 204*a* near the first precious metal tip 241 can be further reduced, so that the possibility that the flame core will come into contact with the ground electrode body 204*a* can be lowered more effectively.

Moreover, when the shortest distance D3 between the first precious metal tip 241 and the slope 246 is not smaller than 0.25 mm, a space for forming a molten portion 243 by laser welding is sufficiently secured between the first precious metal tip 241 and the slope 246, so that the first precious metal tip 241 and the ground electrode body 204*a* can be firmly bonded to each other.

The molten portion 243 is formed to extend to the slope 246. Accordingly, when the limited space between the first precious metal tip 241 and the slope 246 is used most effectively to form the molten portion 243, the bonding strength between the first precious metal tip 241 and the ground electrode body 204*a* can be maximized.

The shortest distance D2 between the first precious metal tip 241 and a portion P1 of the molten portion 243 nearest to one end (not shown) of the ground electrode body 204*a* is 1.0 mm. When the shortest distance D2 is set to be larger than the shortest distance D3 between the slope 246 and the first precious metal tip 241, that is, D2>D3, the bonding strength between the first precious metal tip 241 and the ground electrode body 204*a* can be improved as a whole in the limited space for forming molten portion 243. In order to sufficiently obtain such an effect, D2 is set to be not smaller than twice as large as D3. In this embodiment, the portion P1 is located in the middle of the inner circumferential surface 45 of the ground electrode body 4*a*, but P1 can also be located away from the middle.

EXAMPLES

Example 1

In order to confirm the effect of the invention, various tests were carried out as follows.

Various samples of the spark plug having the shape shown in FIGS. 1 and 2 were prepared as follows. First, sintered alumina ceramic, INCONEL 600, Ir-20 wt % Rh and Pt-20 wt % Ni were selected as the materials of the insulator 2, the center electrode body 3*a* of the center electrode 3, the second precious metal tip 31 and the first precious metal tip 41, respectively. The first precious metal tip 41 was shaped in the form of a column having a height t of 0.8 mm and a diameter of ϕ0.6 mm.

After the angles θ1 and θ2 in FIG. 2 were set as shown in Table 1, the spark plug 100 was attached to a six-cylinder DOHC gasoline engine having a displacement of 2000 cc. An ignitability test was performed while the engine was idling (at an engine rotational speed of 700 rpm). In this test, the value of A/F (air-fuel) measured when a HC spike occurred ten times per three minutes under the aforementioned engine condition was regarded as an ignition limit to examine the ignitability of the spark plug 100. According to this test, it has been already found that hydrocarbon (HC) is generated when the engine fails to be ignited. For this reason, the value of A/F measured when an HC spike has occurred by a predetermined number of times can be regarded as an ignition limit. Those samples exhibiting an A/F of not smaller than 18 are marked with "OO", those samples exhibiting an A/F of not smaller than 17.5 and smaller than 18 are marked with "o", those samples exhibiting an A/F of not smaller than 17 and smaller than 17.5 are marked with "Δ", and those samples exhibiting an A/F of smaller than 17 are marked with "x". The results of the test are shown in Table 1.

TABLE 1

| No. | θ1 | θ2 | θ1 + θ2 | Ignitability |
|---|---|---|---|---|
| A | 5 | 45 | 50 | ○○ |
| B | 20 | 45 | 65 | ○ |
| C | 45 | 35 | 80 | ○ |
| D | 50 | 35 | 85 | ○ |
| E | 45 | 45 | 90 | Δ |
| F | 45 | 48 | 93 | Δ |
| G | 45 | 50 | 95 | x |
| H | 60 | 45 | 105 | x |

As shown in Table 1, the A/F in each of Sample A (θ1+θ2=50°), Sample B (θ1+θ2=65°), Sample C (θ1+θ2=80°), Sample D (θ1+θ2=85°), Sample E (θ1+θ2=90°) and Sample F (θ1+θ2=93°) was not smaller than 17 whereas the A/F in each of Sample G (θ1+θ2=95°) and Sample H (θ1+θ2=105°) was smaller than 17. When the value of θ1+θ2 is set to be not larger than 93° in this manner, good ignitability is obtained. Further, the A/F in each of Samples A, B, C and D was not smaller than 17.5. When the value of θ1+θ2 is set to be not larger than 85°, ignitability is improved. In addition, the A/F in Sample A was not smaller than 18. When the value of θ1+θ2 is set to be not larger than 50°, efficient and excellent ignitability is obtained.

Example 2

Similarly to Example 1, various samples of the spark plug having the shape shown in FIGS. 1 and 2 were prepared as follows. Specifically, sintered alumina ceramic, INCONEL 600, Ir-20 wt % Rh and Pt-20 wt % Ni were selected as the materials of the insulator 2, the center electrode body 3*a* of the center electrode 3, the second precious metal tip 31 and the first precious metal tip 41, respectively. The first precious metal tip 41 was shaped in the form of a column having a height t of 0.8 mm and a diameter of ϕ0.6 mm.

After the angles θ1 and θ2 in FIG. 2 were set as shown in Table 2, the spark plug 100 was attached to a six-cylinder DOHC gasoline engine having a displacement of 2000 cc. An ignitability test was performed in the same manner as Example 1 while the engine was idling (at an engine rotational speed of 700 rpm). In this test, the value of A/F (air-fuel) measured when an HC spike occurred ten times per three minutes under the aforementioned engine conditions was regarded as an ignition limit to examine the ignitability of the spark plug 100. Those samples exhibiting an A/F of not smaller than 18 are marked with "OO", and those samples exhibiting an A/F of not smaller than 17.5 and smaller than 18 are marked with "o". The results of the test are shown in Table 2.

TABLE 2

| No. | θ1 | θ2 | θ1 + θ2 | Ignitability |
|---|---|---|---|---|
| D | 50 | 35 | 85 | ○ |
| I | 45 | 40 | 85 | ○○ |
| J | 40 | 45 | 85 | ○○ |

According to Table 2, the A/F in each of Sample I (θ1=45° and θ2=40°) and Sample J (θ1=40° and θ2=45°) was not smaller than 18 whereas the A/F in Sample D (θ1=50° and θ2=35°) was not smaller than 17.5 and smaller than 18. When θ1 is set to be not larger than 45°, efficient and excellent ignitability is obtained.

The present invention is not limited to the above specific embodiments. Various modifications may be made in accordance with purposes and applications within the spirit and scope of the invention. For example, the center electrode 3 in the spark plug 100 according to the invention is not limited to a center electrode 3 provided with the second precious metal tip 31. That is, the center electrode may be substituted with one not having a second precious metal tip 31.

In the spark plug 100 according to the invention, each of the center electrode 3 and the ground electrode 4 has only an electrode body. The invention is not limited thereto. For example, the center electrode 3 may be formed as a center electrode which has an electrode body formed as its surface, and a metal core that is embedded in the electrode body. Similarly, the ground electrode 4 may be formed as a ground electrode which has an electrode body formed as its surface, and a metal core that is embedded in the electrode body. In this case, the metal core may be made of a metal such as Cu, Ag, etc. or of an alloy of Cu, Ag, etc.

This application is based on Japanese Patent application JP 2003-336322, filed Sep. 26, 2003, the entire content of which is hereby incorporated by reference, the same as if set forth at length.

What is claimed is:

1. A spark plug comprising:

an insulator having an axial hole formed in an axial direction along an axis of said spark plug;

a center electrode disposed in said axial hole of said insulator and on a leading end side of said axial hole;

a metal shell surrounding said insulator; and a ground electrode including a ground electrode body having a first end joined to said metal shell, and a first precious metal tip formed in a second end portion of said ground electrode body so that a leading end surface of said first precious metal tip is disposed opposite said center electrode, wherein:

said ground electrode further includes a molten portion between said first precious metal tip and said ground electrode body;

said first precious metal tip is laser-welded to an inner circumferential surface of said ground electrode body to form said molten portion in a condition such that a shortest distance D1 between said first precious metal tip and said other end surface of the second end of said ground electrode body is not smaller than 0.25 mm;

said molten portion extends to said second end surface of said ground electrode body; and said shortest distance D1 satisfies a relation D2>D1 in which D2 is a shortest distance between said first precious metal tip and a portion of said molten portion nearest to said first end of said ground electrode body as viewed from said inner circumferential surface of said ground electrode body.

2. The spark plug as claimed in claim 1, wherein D2 is not smaller than twice D1.

3. A spark plug comprising:

an insulator having an axial hole formed in an axial direction along an axis of said spark plug;

a center electrode disposed in said axial hole of said insulator and on a leading end side of said axial hole;

a metal shell surrounding said insulator; and a ground electrode including a ground electrode body having a first end joined to said metal shell, and a first precious metal tip formed in a second end portion of said ground electrode body so that a leading end surface of said first precious metal tip is disposed opposite said center electrode, wherein:

said ground electrode body has an inner circumferential surface and has a slope formed in a corner portion between each of opposite side surfaces of said ground electrode body and an end surface of the second end of said ground electrode body; and said ground electrode body satisfies a relation D3<D1 in which D3 is a shortest distance between said first precious metal tip and said slope, and D1 is a shortest distance between a plane defined by an end surface of the second end of said ground electrode body and said first precious metal tip as viewed from said inner circumferential surface of said ground electrode body.

4. The spark plug as claimed in claim 3, wherein:

said ground electrode further includes a molten portion between said first precious metal tip and said ground electrode body; and said first precious metal tip is laser-welded to said ground electrode body to form said molten portion in a condition such that a shortest distance D3 between said first precious metal tip and said slope is not smaller than 0.25 mm.

5. The spark plug as claimed in claim 4, wherein said molten portion extends to said slope.

6. A spark plug comprising:

an insulator having an axial hole formed in an axial direction along an axis of said spark plug;

a center electrode disposed in said axial hole of said insulator and on a leading end side of said axial hole;

a metal shell surrounding said insulator; and a ground electrode including a ground electrode body having a first end joined to said metal shell, and a first precious metal tip formed in a second end portion of said ground electrode body so that a leading end surface of said first precious metal tip is disposed opposite said center electrode, wherein:

said ground electrode further includes a molten portion between said first precious metal tip and said ground electrode body;

said ground electrode body has an inner circumferential surface and has a slope formed in a corner portion between each of opposite side surfaces of said ground electrode body and an end surface of the second end of said ground electrode body; and and said spark plug satisfies a relation D2>D3 in which D3 is a shortest distance between said first precious metal tip and said slope, and D2 is a shortest distance between said first precious metal tip and a portion of said molten portion nearest to said first end of said ground electrode body as viewed from said inner circumferential surface of said ground electrode body.

7. The spark plug as claimed in claim 6, wherein D2 is not smaller than twice D3.

* * * * *